US010174437B2

(12) United States Patent
Harris et al.

(10) Patent No.: US 10,174,437 B2
(45) Date of Patent: Jan. 8, 2019

(54) WAFER ELECTROPLATING CHUCK ASSEMBLY

(71) Applicant: APPLIED Materials, Inc., Santa Clara, CA (US)

(72) Inventors: Randy A. Harris, Kalispell, MT (US); Michael Windham, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 73 days.

(21) Appl. No.: 15/198,945

(22) Filed: Jun. 30, 2016

(65) Prior Publication Data

US 2017/0009367 A1 Jan. 12, 2017

Related U.S. Application Data

(60) Provisional application No. 62/190,603, filed on Jul. 9, 2015.

(51) Int. Cl.
*C25D 17/00* (2006.01)
*C25D 17/06* (2006.01)

(52) U.S. Cl.
CPC ..... *C25D 17/001* (2013.01); *C25D 17/004* (2013.01); *C25D 17/06* (2013.01); *C25D 17/005* (2013.01)

(58) Field of Classification Search
CPC ..... C25D 17/001; C25D 17/004; C25D 7/12; C25D 7/123; C25D 7/126; H01L 21/68721
See application file for complete search history.

(56) References Cited

U.S. PATENT DOCUMENTS 6,080,291 A * 6/2000 Woodruff ..... C25D 17/001 204/212
6,156,167 A * 12/2000 Patton ..... C25D 7/12 204/270
6,251,238 B1 * 6/2001 Kaufman ..... H01L 21/2885 204/242
6,258,223 B1 7/2001 Cheung et al.
(Continued)

OTHER PUBLICATIONS

International Application Division, Korean Intellectual Property Office, The International Search Report and the Written Opinion issued in International Application No. PCT/US2016/040952 (dated Sep. 12, 2016).

*Primary Examiner* — Tyrone V Hall, Jr.
(74) *Attorney, Agent, or Firm* — Perkins Coie LLP; Kenneth H. Ohriner

(57) ABSTRACT

A wafer is placed into a chuck assembly within an electroplating system. The chuck assembly includes a backing plate assembly engageable with a ring. A hub may be provided on one side of the backing plate assembly for attaching the chuck assembly to a rotor of a processor for electroplating a wafer. A wafer plate may be provided on the other side of the backing plate assembly. The ring has contact fingers electrically connected to a ring bus bar, and with the ring bus bar electrically connected to a power source in the processor via the backing plate assembly when the ring is engaged to the backing plate assembly. A wafer seal on the ring overlies the contact fingers. A chuck seal may be provided around a perimeter. Maintenance of the electrical contacts and the seal is performed remotely from the processors.

16 Claims, 11 Drawing Sheets

(56) References Cited

U.S. PATENT DOCUMENTS

| | | | | |
|---|---|---|---|---|
| 6,303,010 | B1 * | 10/2001 | Woodruff | H01L 21/288 204/297.01 |
| 6,398,926 | B1 * | 6/2002 | Mahneke | C25D 7/12 204/224 R |
| 6,471,913 | B1 | 10/2002 | Weaver et al. | |
| 6,623,609 | B2 | 9/2003 | Harris et al. | |
| 6,802,947 | B2 | 10/2004 | Olgado et al. | |
| 7,033,465 | B1 * | 4/2006 | Patton | C23C 18/1605 204/212 |
| 7,288,489 | B2 | 10/2007 | Dolechek et al. | |
| 7,351,314 | B2 | 4/2008 | Klocke et al. | |
| 7,371,306 | B2 | 5/2008 | Davis et al. | |
| 7,811,422 | B2 * | 10/2010 | Zimmerman | C25D 17/004 204/199 |
| 7,935,231 | B2 * | 5/2011 | Ghongadi | C25D 21/08 204/199 |
| 2002/0029961 | A1 | 3/2002 | Dordi et al. | |
| 2002/0029962 | A1 | 3/2002 | Stevens et al. | |
| 2004/0149573 | A1 | 8/2004 | Herchen | |
| 2005/0014368 | A1 * | 1/2005 | Yoshioka | C25D 17/06 438/689 |
| 2006/0226000 | A1 | 10/2006 | Hanson et al. | |
| 2006/0283704 | A1 | 12/2006 | Yamamoto et al. | |
| 2012/0037495 | A1 | 2/2012 | Woodruff et al. | |
| 2013/0134035 | A1 | 5/2013 | Harris et al. | |
| 2014/0318977 | A1 * | 10/2014 | Moore | C25D 17/06 205/157 |

* cited by examiner

WAFER ELECTROPLATING CHUCK ASSEMBLY

PRIORITY CLAIM

This Application claims priority to U.S. Provisional Patent Application No. 62/190,603 filed Jul. 9, 2015 and incorporated herein by reference.

BACKGROUND

Microelectronic devices are generally formed on a semiconductor wafer or other type substrate or workpiece. In a typical manufacturing process, one or more thin metal layers are formed on a wafer to produce microelectronic devices and/or to provide conducting lines between devices.

The metal layers are generally applied to the wafers via electrochemical plating in an electroplating processor. A typical electroplating processor includes a vessel for holding an electrolyte or plating liquid, one or more anodes in the vessel in contact with the plating liquid, and a head having a contact ring with multiple electrical contact fingers that touch the wafer. The front surface of the workpiece is immersed in the plating liquid and an electrical field causes metal ions in the plating liquid to plate out onto the wafer, forming a metal layer. Generally multiple electroplating processors are provided within an enclosure, along with other types of processors, to form an electroplating system.

The electrical contacts on the contact ring require frequent maintenance for cleaning and/or deplating. A so-called dry contact electroplating processor uses a seal to keep the plating liquid away from the contacts. The seal also requires frequent cleaning. The need to maintain the contacts and the seal reduces the throughput or use efficiency of the electroplating processor, as the electroplating processor is idle during the cleaning procedures. New processing systems overcome this drawback by processing wafers using a contact ring which is built into a chuck assembly which moves through the electroplating system with the wafer, and is not part of the processor. Therefore, contact ring maintenance can be performed in another location of the system, leaving the processor available to continue plating operations. The chuck assembly, however, must be precisely aligned with the processor, and must also securely engage the wafer, both mechanically and electrically. Accordingly, improved designs are needed.

SUMMARY OF THE INVENTION

Figure 1:
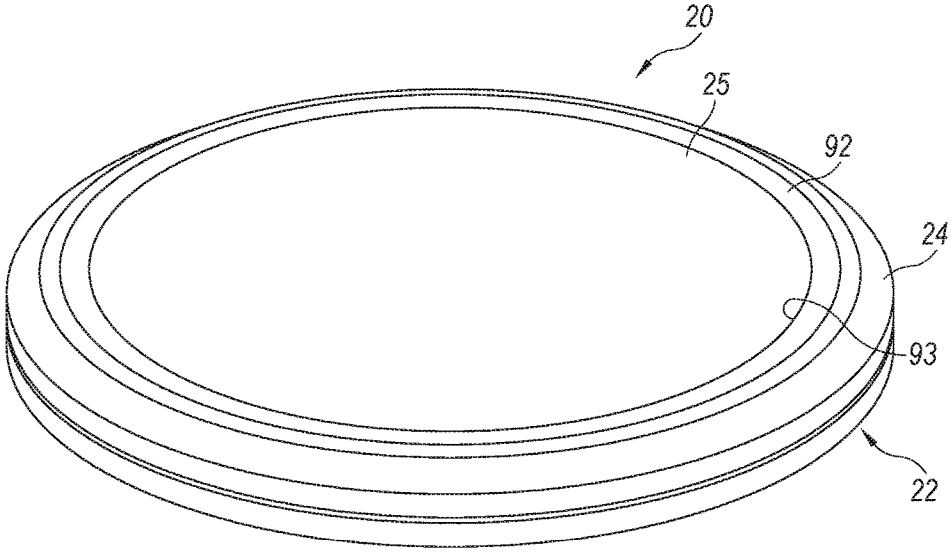
FIG. 1 is a top perspective view of a chuck assembly holding a wafer.

A chuck assembly includes a backing plate engageable with a ring. A hub may be provided on one side of the backing plate for attaching the chuck assembly to a rotor of a processor for electroplating a wafer. A wafer plate may be provided on the other side of the backing plate. The ring has contact fingers electrically connected to a ring bus bar, and with the ring bus bar electrically connected to a power source in the processor via the backing plate when the ring is engaged to the backing plate.

A wafer seal on the ring overlies the contact fingers. A chuck seal may be provided around a perimeter of the ring for sealing against the backing plate when the ring is engaged to the backing plate. The hub may have electrical contacts electrically connected to the ring bus bar.

DETAILED DESCRIPTION OF THE DRAWINGS

Referring to FIGS. 1-3 and 14, a chuck assembly 20 is used in an electroplating system 220 for electroplating a semiconductor substrate or wafer 25. The chuck assembly 20 includes a ring 24 and a backing plate assembly 22.

Figure 7:
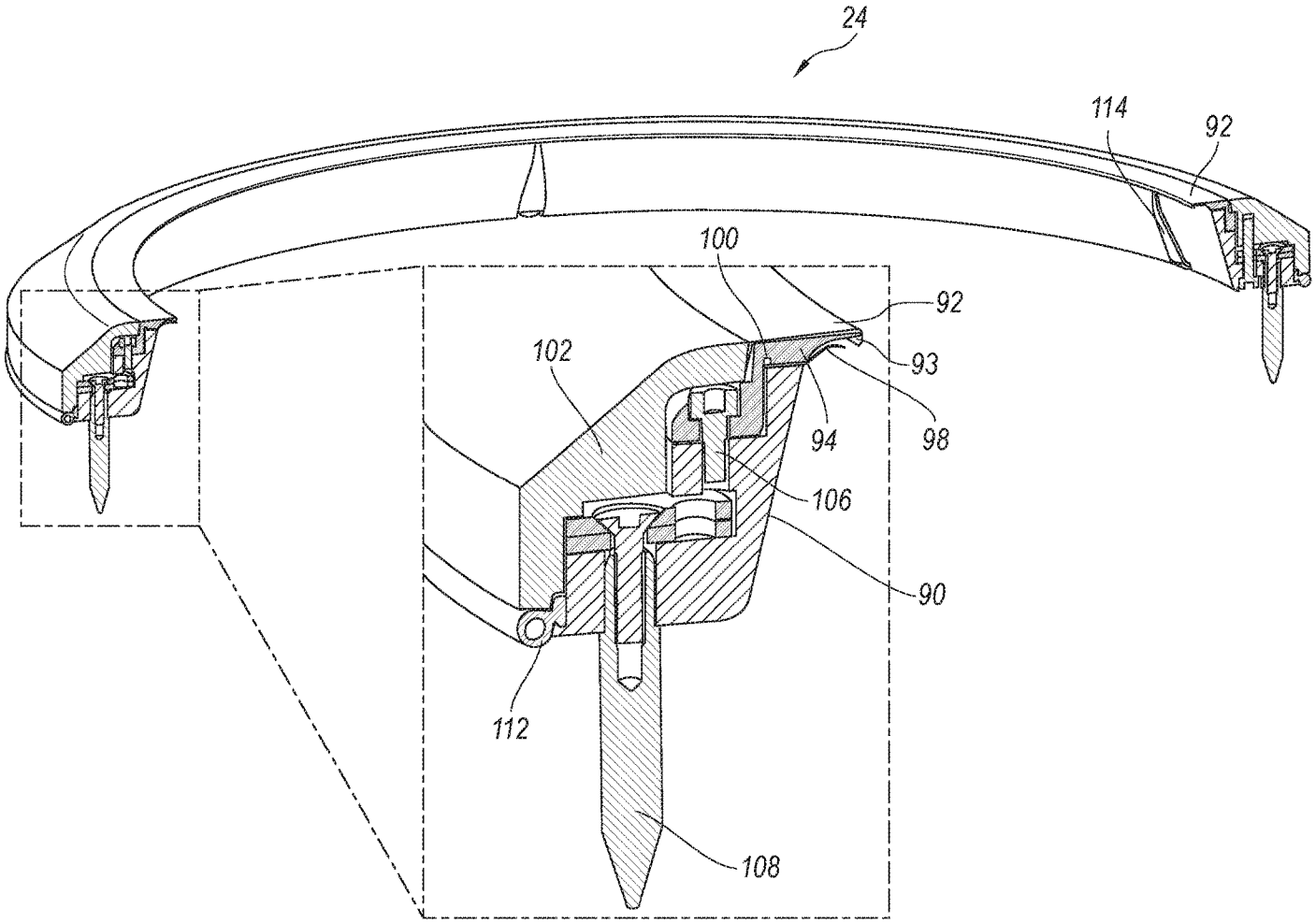
FIG. 7 is an enlarged detail view of the ring shown in FIG. 2.
Figure 8:
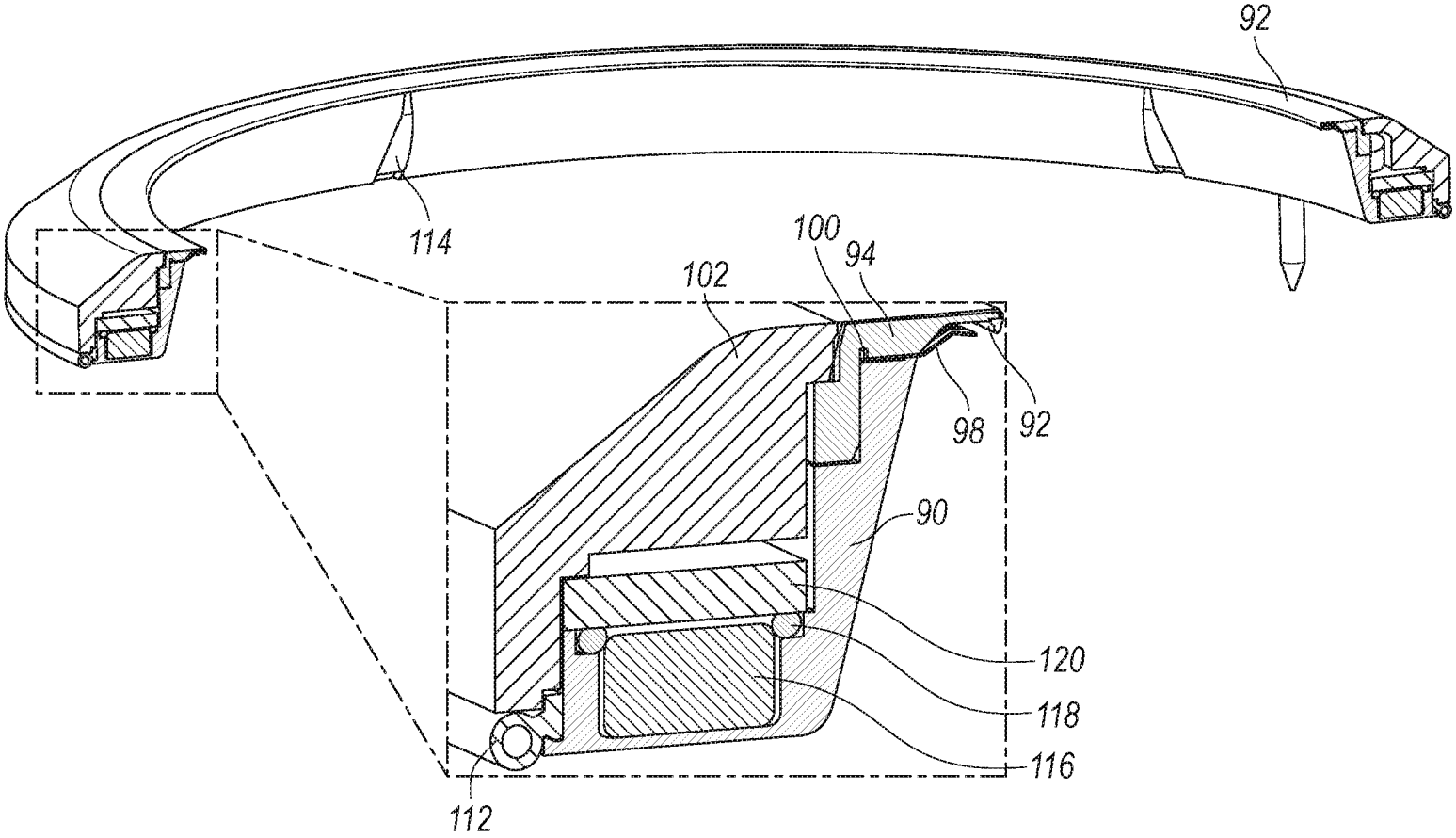
FIG. 8 is an enlarged detail view of elements shown in FIG. 6.
Figure 11:
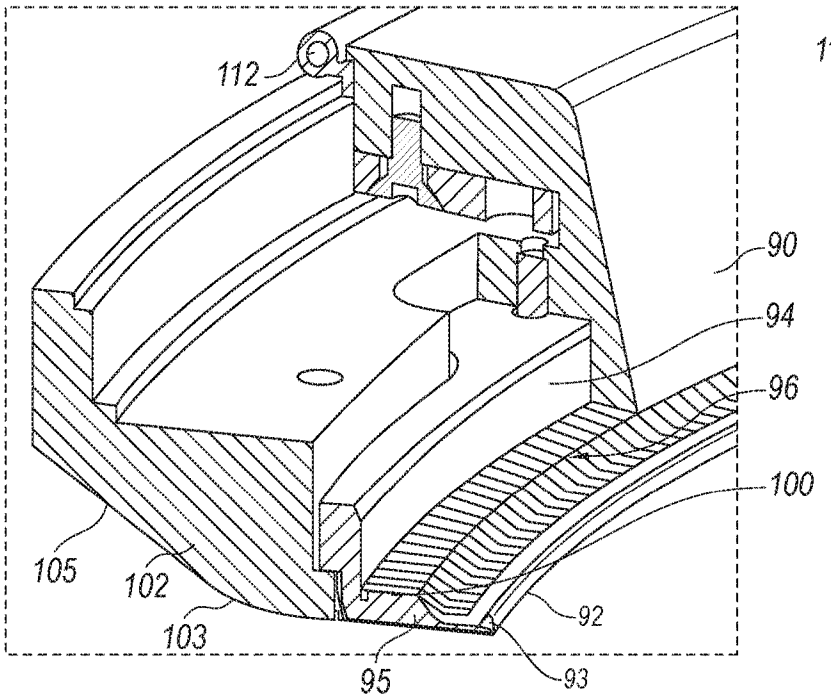
FIG. 11 is an enlarged detail view of elements of the ring shown in FIG. 10.

Turning to FIGS. 7 and 8, the ring 24 includes a wafer seal 92, electrical contact fingers 98, a ring bus bar 90, a seal retainer 102, a chuck seal 112, centering pins 108 spaced apart at the perimeter of the ring 24, and wafer guides 114. The wafer seal 92 provides a barrier to keep the plating liquid away from the electrical contact fingers 98. The electrical contact fingers 98 provide a uniform physical contact onto the wafer 25 for the purpose of uniform electroplating material onto the wafer 25. The electrical contact fingers 98 may be manufactured in straight strips or segments using a progressive die process that provides a very precise dimensional tolerance as described in International Patent Publication WO2013/081823. For plating a 300 mm diameter wafer, the ring 24 may have e.g., 720 electrical contact fingers 98 on 4-8 segments. As shown in FIG. 11, the wafer seal 92 may have an insert section 94 and a contact section 95 generally perpendicular to the insert section 94, with the insert section 94 clamped between the ring bus bar 90 and the seal retainer 102, and with the contact section 95 overlying the electrical contact fingers 98.

The electrical contact fingers 98 may be precisely positioned relative to the inner diameter 93 of the wafer seal 92 (which is the part of the wafer seal 92 that touches the wafer 25) by a contact locator groove 100. The back edge of the contact segment or strip 96 may have a downward fold or tabs inserted into the contact locator groove 100. This closely controls the dimensional tolerance between the inner diameter 93 of the wafer seal 92 and the tips of the electrical contact fingers 98, allowing a larger area of the wafer 25 to be exposed to the plating liquid, therefore providing more die per wafer 25. The contact locator groove 100 may be located in the contact section 95 at the outer perimeter of the contact section 95, where the contact section 95 joins to or intersects with the insert section 94.

Figure 10:
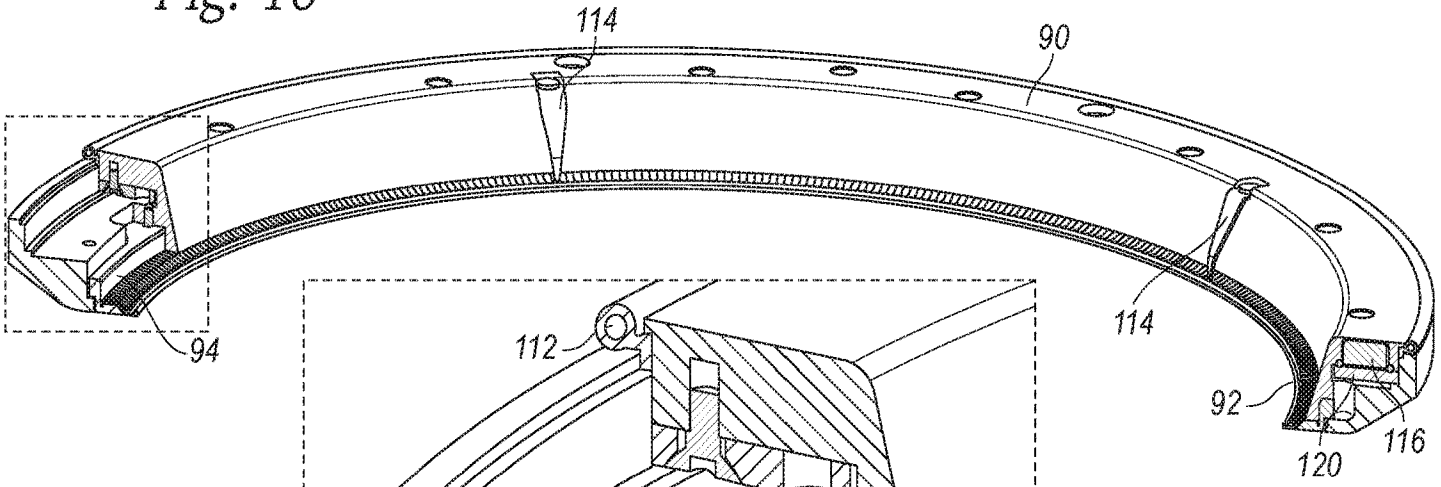
FIG. 10 is a bottom perspective view of the ring shown in FIG. 7.

The contact segments or strips 96 may be formed into a curved arc by assembling them into the contact locator groove 100 in the wafer seal 92, as shown in FIG. 10. The contact segments 96 are then clamped and secured into a fixed position in the ring 24 via the fasteners 106 shown in FIG. 7 which attach the wafer seal 92 to the ring bus bar 90.

Figure 9:
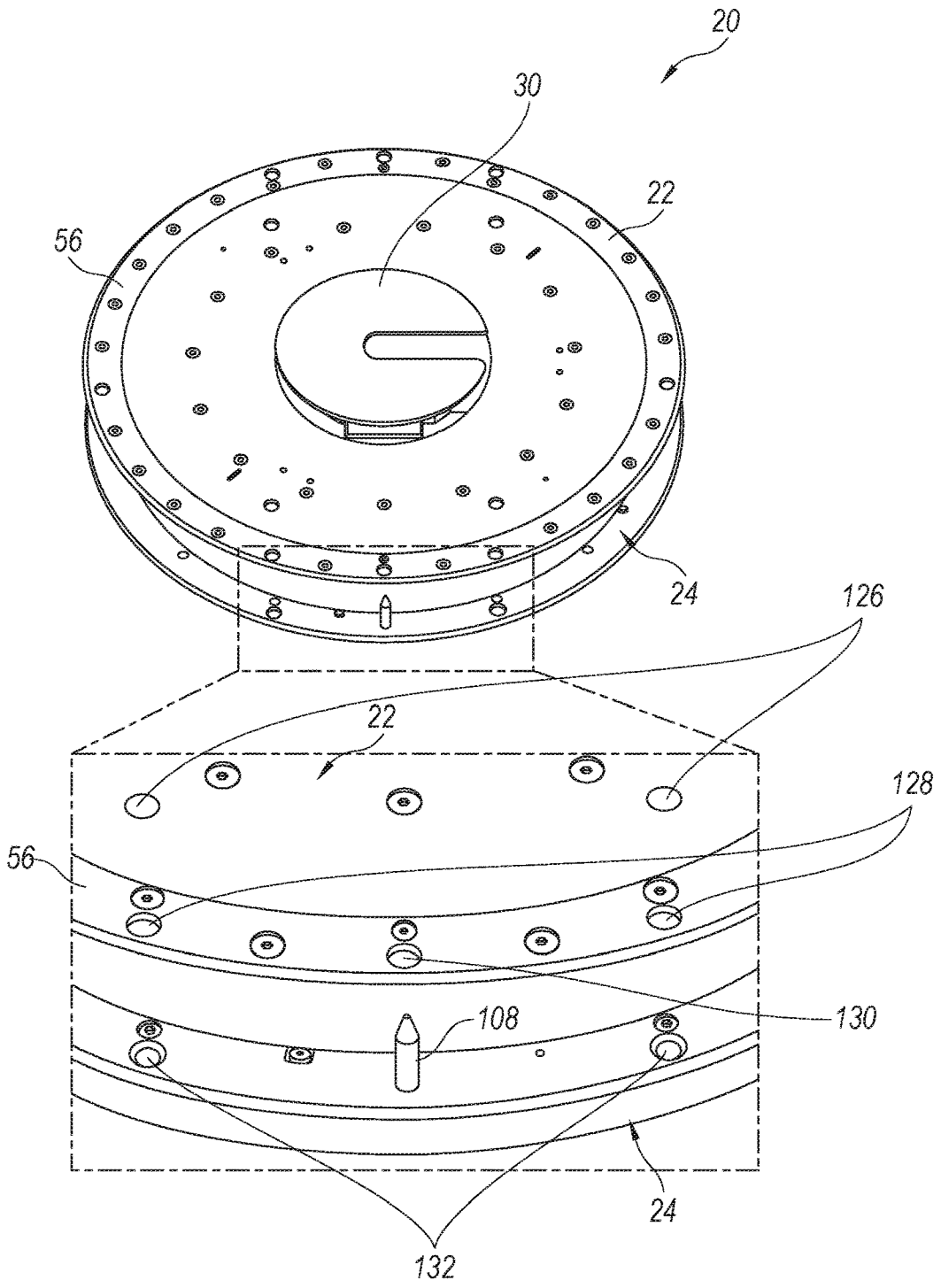
FIG. 9 is a bottom perspective view of the chuck assembly as shown in FIG. 3.

Referring still to FIGS. 7 and 8, the ring bus bar 90 provides an electrical connection between the backing plate assembly 22 and the electrical contact fingers 98. The ring bus bar 90 has location and mounting holes for the wafer seal 92, recesses for the ring magnets 116 and slots for mounting the wafer guides 114. The wafer guides 114 may be flexible metal springs. The centering pins 108 are also attached to the ring bus bar 90. To align the ring 24 with the rotor 206 of the processor 202, and specifically to align the inner diameter 93 of the wafer seal 92 with the rotor 206, the centering pins 108 on the ring 24, shown in FIG. 9, pass through clearance holes 130 in the backing plate assembly 22, and engage into alignment holes 208 in the rotor 206 shown in FIG. 14.

The centering pins 108 ensure the wafer seal 92 is concentric to the spin axis of the processor 202. The wafer guides 114 on the ring bus bar 90 are calibrated with respect to the inner diameter 93 of the wafer seal 92, and also operate to center the wafer 25 with respect to the wafer seal 92. This provides good wafer positional repeatability within the dimensional tolerances of the wafers 25.

The seal retainer 102 provides a barrier keeping the plating liquid away from the electrically conductive elements of the ring 24, i.e., the ring bus bar 90 and the electrical contact fingers 98. The seal retainer 102 seals against the outside diameter of the wafer seal 92 and also seals against the chuck seal 112 when the chuck assembly 20 is in the closed position as shown in FIG. 1. As shown in FIG. 11, the seal retainer 102 has a radius 103 leading to an angled surface 105, to provide a smooth entry of the chuck assembly 20 into the plating liquid in the vessel 210.

As shown in FIGS. 7, 8 and 11, the chuck seal 112 is attached to the outer diameter of the ring 24. The chuck seal 112 provides a liquid resistant interface between the ring 24 and backing plate assembly 22 during the electroplating process as well as the rinse process. The tubular shape of the chuck seal 112 reduces trapping of plating liquid.

Figure 6:
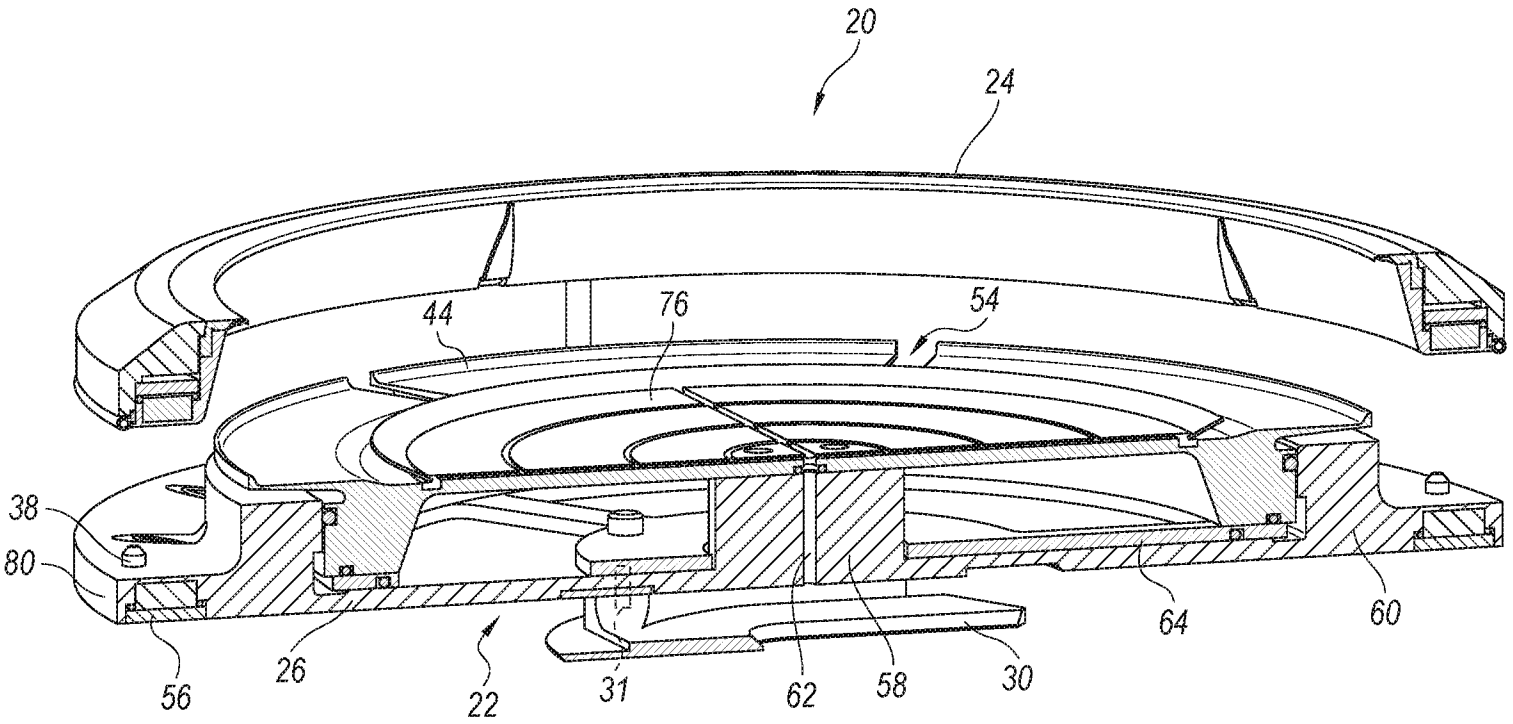
FIG. 6 is a top perspective section view of the chuck assembly rotated from the view of FIG. 4.

Turning to FIGS. 6 and 8, the ring 24 contains ring magnets 116 which attract the backing plate magnets 80 in the backing plate assembly 22 to provide clamping force between the backing plate assembly 22 and the ring 24. The ring magnets 116 are positioned in recesses spaced apart around the ring bus bar 90. Each ring magnet 116 is sealed within a recess by a magnet plate 120 compressed onto a magnet seal or O-ring 118.

As shown in FIG. 6, the backing plate assembly 22 has a base plate 26 containing backing plate magnets 80. The backing plate magnets 80 are sealed with O-rings clamped beneath a bottom ring 56. The hub 30 and a backing plate bus bar 64 are attached to the base plate 26. An electrical path from the processor 202 to the electrical contact fingers 98 is made through the electrical contacts 31 in the hub 30, to the backing plate bus bar 64, then through the chuck contacts 40 to the ring bus bar 90.

Figure 3:
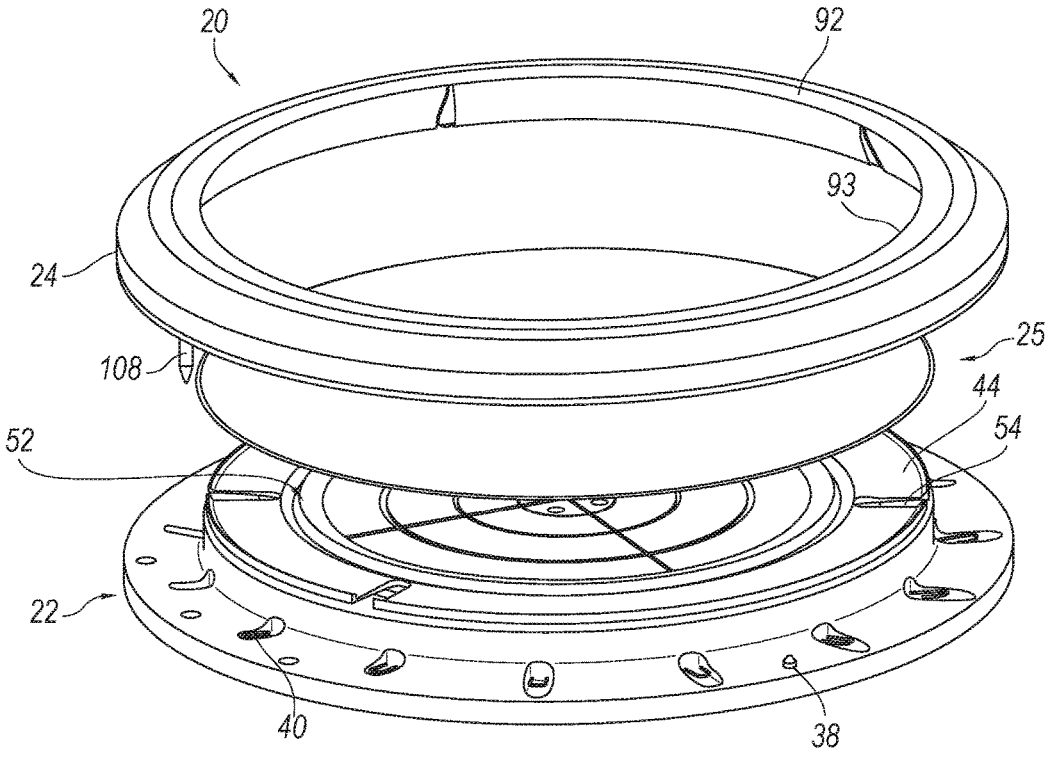
FIG. 3 is a top perspective exploded view of the chuck assembly of FIG. 1.

The hub 30 contains abrasion resistant bushings 34 to allow the robot 200 to engage and lift the chuck assembly 20 with excessive wear or particle generation. Ring location pins 38 on the base plate 26, as shown in FIG. 3, ensure correct orientation of the ring 24 to the backing plate assembly 22. The backing plate bus bar 64 and the ring bus bar 90 can of course be replaced with other forms of electrical conductors, such as wires.

Figure 4:
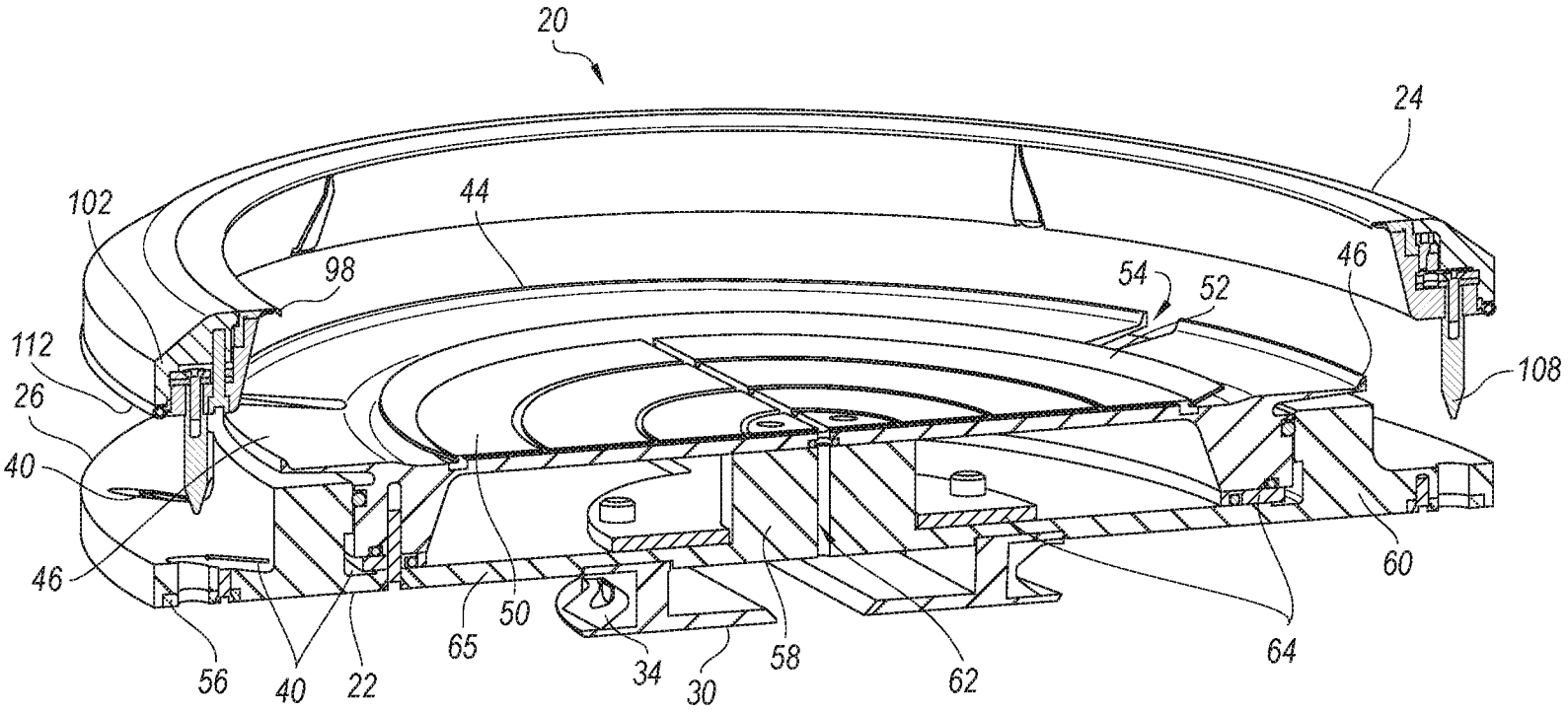
FIG. 4 is a top perspective section view of the chuck assembly of FIG. 1.
Figure 5:
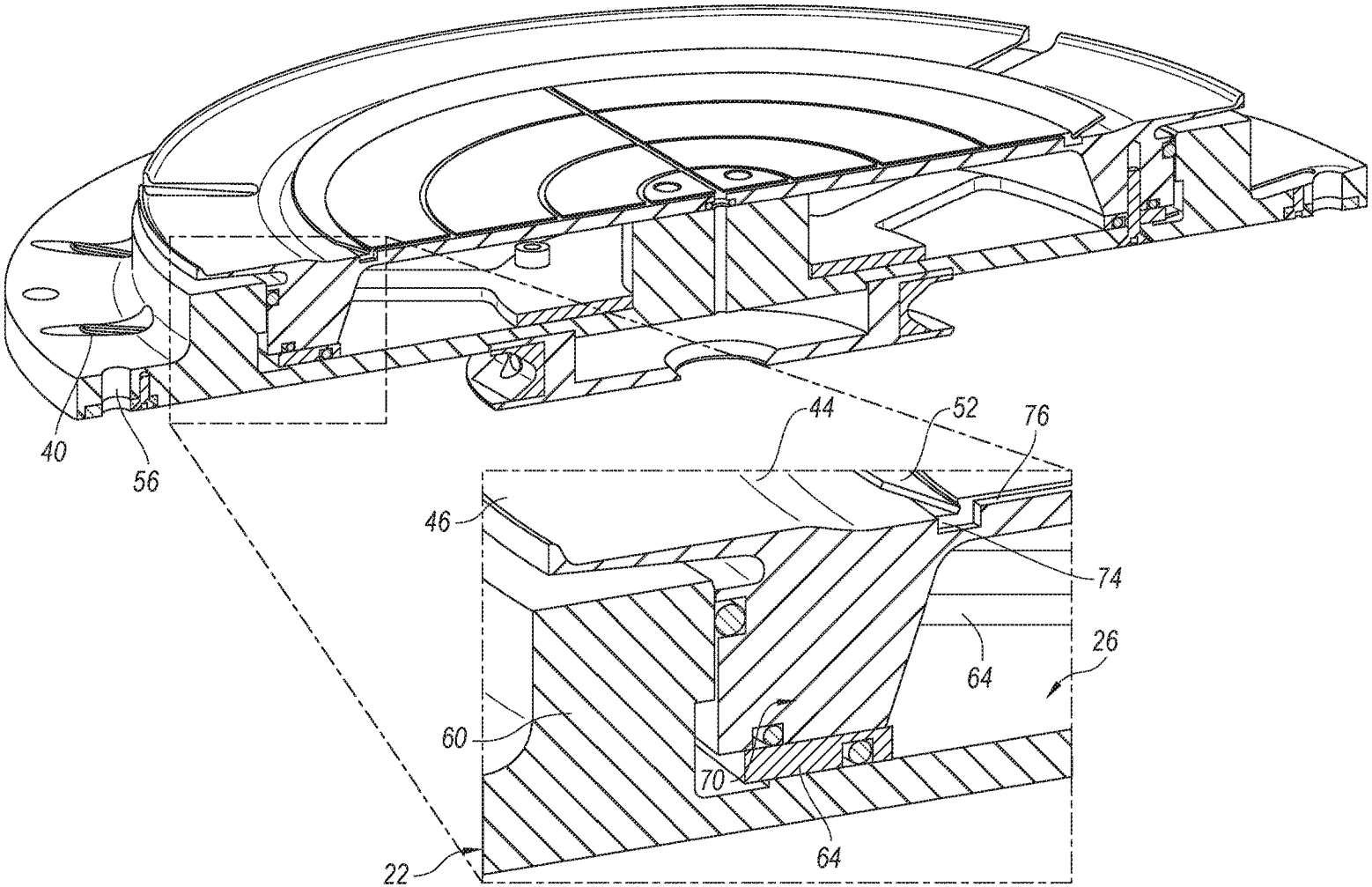
FIG. 5 is an enlarged detail view of elements of the chuck assembly of FIG. 1.

As shown in FIGS. 4, 5 and 6, the backing plate assembly 22 may include a wafer plate 44 supported on the base plate 26 having a central post 58 joined to an outer rim 60 by a generally flat web section 65. The wafer plate 44 is supported on and sealed against the base plate 26. As shown in FIG. 4, the wafer plate 44 may have a flange 46 extending radially outwardly from a wafer extract seal 52. A vacuum port 62 optionally extends up through the central post 58 and leads into vacuum channels 76 on the wafer plate 44. A vacuum vent 74 extends entirely through the wafer plate 44. The backing plate bus bar 64 may have an inner ring electrically connected to electrical contacts 31 in the hub 30, an outer ring electrically connected to chuck contacts 40, and spokes connecting the inner and outer rings.

The wafer extract seal 52 provides a seal to the backside surface of the wafer 25. A vacuum may be applied to the vacuum port 62 and the vacuum channels 76 in the wafer plate 44 from a vacuum source in or connected to the electroplating system 220. A vacuum sensor 205 measures the pressure in the space between the back side of the wafer 25 and the wafer plate 44. The sensed pressure may be used to confirm the presence of a wafer 25 in the chuck assembly 20.

Vacuum may also be applied at different steps of the chuck assembly opening sequence to monitor wafer status in the chuck assembly 20. Where an initial vacuum measurement P1 exceeds a subsequent measurement P2 (taken after the system control computer 207 indicates the wafer has been lifted up off of the wafer extract seal 52) by a predetermined value, the system control computer 207 is notified that the wafer 25 was not successfully extracted. If the differential is below a predetermined value, the system control computer 207 is notified that the wafer 25 was successfully extracted. The vacuum vent 74 in the wafer plate 44 quickly equalizes pressure after the vacuum is turned off. This prevents the wafer from sticking to the wafer plate 44. The vacuum can be turned on after chuck assembly is opened, as shown in FIGS. 4 and 6, and vacuum can be applied and rechecked with the previous vacuum values to confirm that there is a predetermined offset. This ensures the electroplating system 220 is operating correctly. The vacuum vent 74 also tends to limit the amount of vacuum applied to the wafer 25, to reduce risk of damage to the wafer from excessive vacuum.

As the chuck assembly 20 is closed, the wafer plate 44 provides engagement force to the backside of the wafer 25 sufficient for the electrical contact fingers 98 and the wafer seal 92 to engage the wafer 25. In the design of FIGS. 4-6, the wafer plate 44 is machined or otherwise manufactured out of plastic and the flange 46 provides the spring rate necessary for contact and sealing. This design works well with wafers having a limited variation in thickness. Where the wafers vary greatly in thickness, the flange 46 may provide too much or too little force for proper operation of the electrical contact fingers 98 and the wafer seal.

Figures 12, 13:
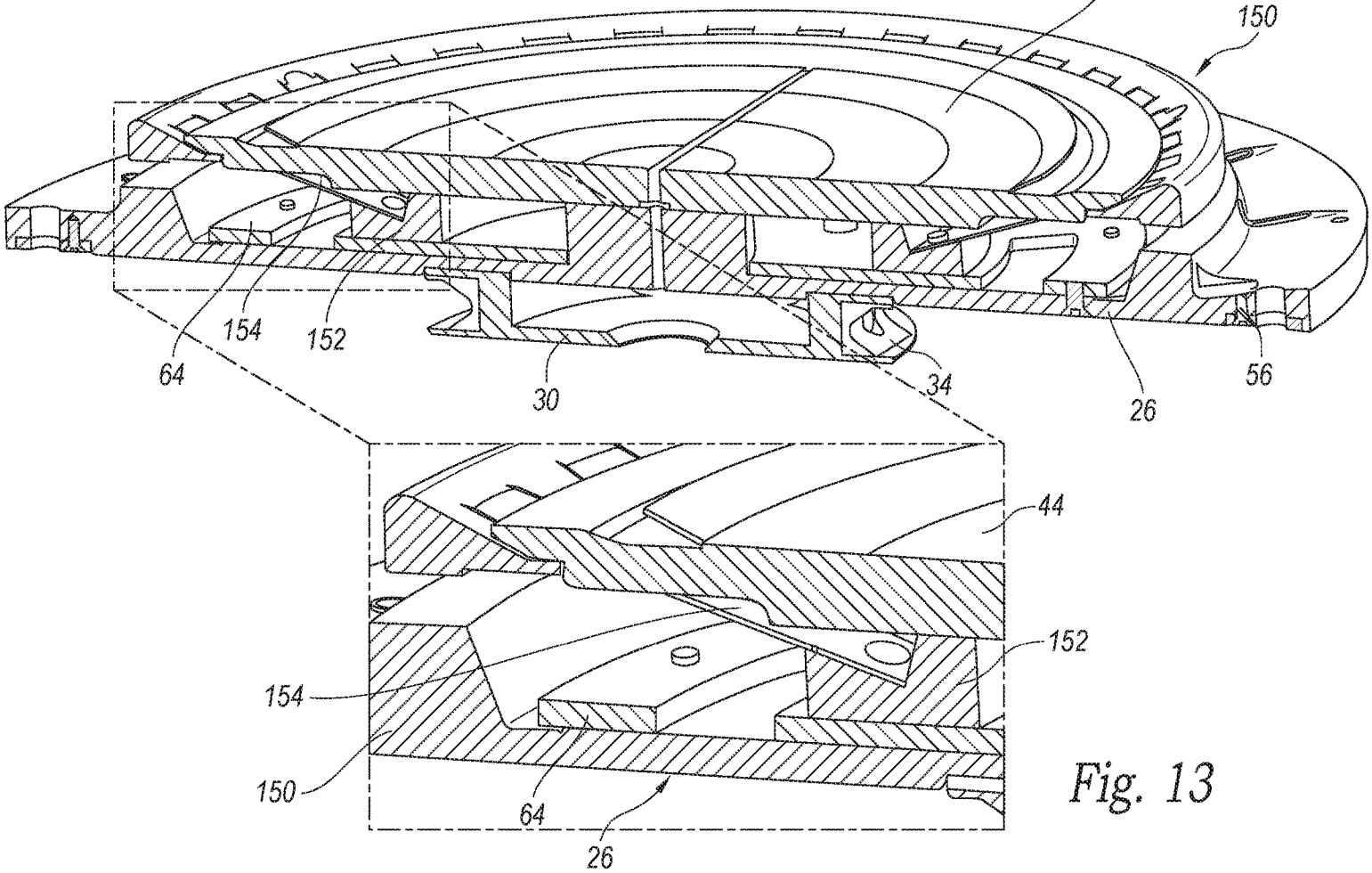
FIG. 12 is a top perspective section view of an alternative chuck assembly design.
FIG. 13 is an enlarged detail view of elements shown in FIG. 12.

FIGS. 12 and 13 show an alternative backing plate 150 having springs 154 which provide a preloaded force to the backside of wafer 25. The springs 154 may be resilient strips joined to a spring hub 152 attached to the base plate 26, with the wafer plate 44 supported on the springs 154. The backing plate 150 allows either a thin and thick wafer to have sufficient force, but not too much force, to engage the wafer seal 92 and the electrical contact fingers 98. The design of FIGS. 12 and 13 may also be used for higher temperature processing as the spring constant of the springs 154 is largely unaffected even over a wide range of temperatures.

The chuck assembly 20 may operate in a processing system as described in International Patent Publication No. WO2014/179234. However, the chuck assembly 20 overcomes various engineering challenges associated with such processing systems. As discussed above, the closing movement of the chuck assembly 20 aligns or centers the wafer 25 relative to the wafer seal 92, and relative to the electrical contact fingers 98. The magnets which hold the ring 24 against the backing plate assembly 22 provide sufficient force to retain the wafer 25 and provide force to obtain good seal pressure and electrical contact between a conductive layer on the wafer, such as a seed layer, and the electrical contact fingers 98. In some embodiments the wafer seal and/or the chuck seal may be omitted.

In use, a wafer 25 is placed onto the wafer plate 44 of the backing plate assembly 22 via a load/unload robot in a wafer load/unload module of the processing system. During loading/unloading the ring 24 is either removed and separated from the backing plate assembly 22, or the ring 24 is spaced apart from the backing plate via ring separation pins in the load/unload module extending up through ring separation clearance holes 128 in the perimeter of the backing plate assembly 22. In either case the chuck assembly 20, which is formed by the backing plate assembly 22 and the ring 24, is effectively in the open position shown in FIGS. 3, 4 and 6. The ring separation pins, if used, engage into ring separation pin recesses 132 in the ring 24. The ring separation pins hold the ring 24 away from the backing plate assembly 22 against the magnetic force attracting the ring 24 to the backing plate assembly 22.

Figure 2:
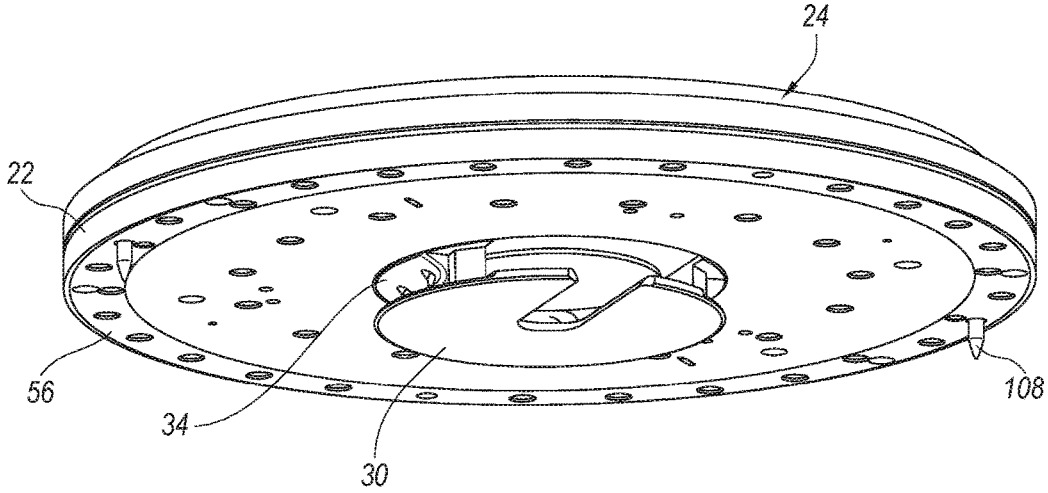
FIG. 2 is a bottom perspective view of the chuck assembly of FIG. 1.
Figure 14:
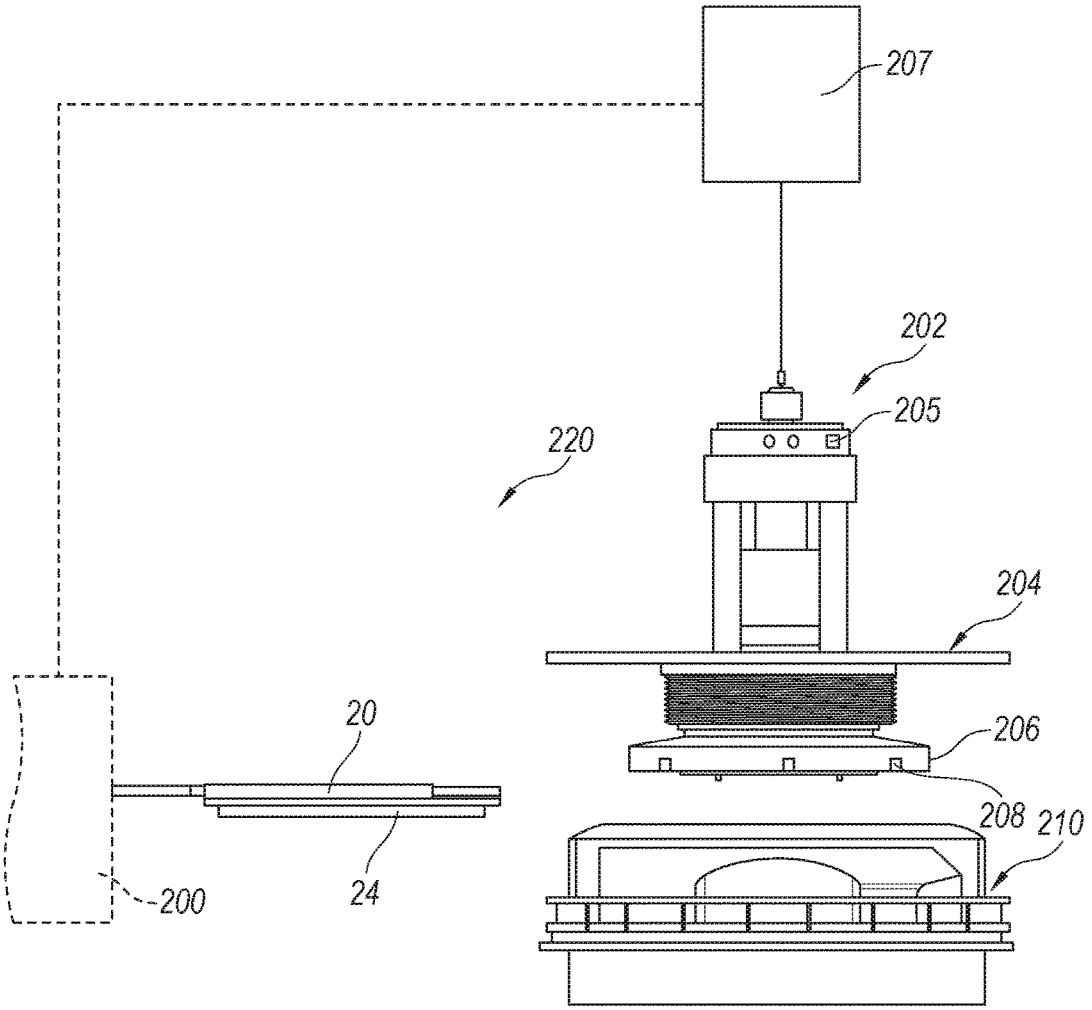
FIG. 14 is a schematic diagram of a robot handing off a chuck assembly to a processor.

After loading, the ring separation pins are retracted and the ring 24 moves into engagement with the backing plate via the magnetic attraction to provide a closed chuck assembly 20 now loaded with a wafer 25 to be electroplated, as shown in FIGS. 1, 2 and 14. The electrical contact fingers 98 and the wafer seal 92 press against the wafer 25.

Referring to FIG. 14, the chuck assembly 20 is moved from the load/unload module to a processor 202 via the robot 200. The chuck assembly 20 is attached to the rotor 206 of the processor 202 via the hub 30 engaging a fitting on the rotor, as described in International Patent Publication No. WO2014/179234. An electric current path is provided from the processor 202 (typically from a cathode in the processor) to the wafer 25 via the fitting to the electrical contacts 31 in the hub 30, the backing plate bus bar 64, the chuck contacts 40, the ring bus bar 90, and to the electrical contact fingers 98 which touch the wafer. As shown in FIG. 3, the chuck contacts 40 make an electrical connection between the backing plate assembly 22 and the ring bus bar 90.

The processor head 204 of the processor 202 moves the wafer 25 held in the chuck assembly 20 into a bath of electrolyte in the vessel 210 of the processor 202 and passes electrical current through the electrolyte to electroplate a metal film onto the wafer 25. After electroplating is complete the sequence of steps described above is reversed. Lift pins in the load/unload module may extend up through lift pin clearance holes 126 in the backing plate to allow the robot to pick up the plated wafer, and the plated wafer 25 is removed from the electroplating system 220 for further processing. The backing plate assembly 22 and the ring 24 may then be cleaned together or separately, and the ring 24 may be deplated in cleaning/deplating modules inside or outside of the electroplating system 220, while the processor 202 electroplates a subsequent wafer using another chuck assembly 20.

Wafer means a silicon or other semiconductor material wafer, or other type substrate or workpiece used to make micro-electronic, micro-electro-mechanical, or micro-optical devices. Bus bar means an electrical conductor including metal plates or strips as well as wires and braids. The systems described may be suitable for use with 150, 200, 300 or 450 mm diameter wafers.

Thus, novel systems, methods and devices have been shown and described. Various changes and substitutions may of course be made without departing from the spirit and scope of the invention. The invention, therefore, should not be limited, except to the following claims and their equivalents.

The invention claimed is:

1. A chuck assembly, comprising:

a backing plate assembly having a base plate;

a hub on a first side of the base plate and a wafer plate on a second side of the base plate, the hub adapted to be engaged by a robot, the hub comprising a disk having a slot extending radially outward from a center area of the disk to an edge of the disk;

a ring engageable with the backing plate assembly;

the ring including a plurality of contact fingers electrically connected to a ring bus bar, and with the ring bus bar electrically connected to the base plate when the ring is engaged to the backing plate assembly;

a wafer seal on the ring overlying the contact fingers, with the wafer seal having an insert section and a contact section, and with the wafer seal having a contact locator groove, with a part of one or more of the contact fingers extending into the contact locator groove.

2. The chuck assembly of claim 1 further including one or more hub electrical contacts in the hub electrically connected to the ring bus bar.

3. The chuck assembly of claim 2 with the hub electrical contacts adapted disengage from processor electrical contacts when the chuck assembly is removed from a processor.

4. The chuck assembly of claim 2 further including a backing plate bus bar on the base plate, with the backing plate bus bar having an inner ring electrically connected to the electrical contacts in the hub.

5. The chuck assembly of claim 4 with the backing plate bus bar further including an outer ring electrically connected to the inner ring and to a plurality of spaced apart chuck contacts on the base plate.

6. The chuck assembly of claim 1 further including a seal retainer attached to the ring bus bar, wherein the wafer seal and a chuck seal are secured onto the ring bus bar by the seal retainer.

7. The chuck assembly of claim 6 further including a plurality of wafer guides spaced apart on an inside diameter of the ring bus bar.

8. The chuck assembly of claim 1 further including a chuck seal around a perimeter of the ring for sealing against the base plate when the ring is engaged to the backing plate assembly.

9. The chuck assembly of claim 8 wherein the plurality of contact fingers are provided on at least one contact finger segment having a downward fold or tab at a back end of the at least one contact finger segment inserted into the contact locator groove to align an inner diameter of the wafer seal with inner tips of the electrical contact fingers.

10. The chuck assembly of claim 1 further including at least one vacuum channel in the wafer plate and a wafer extract seal around the at least one vacuum channel.

11. The chuck assembly of claim 10 with the at least one vacuum channel extending through the hub.

12. The chuck assembly of claim 10 with the wafer plate including a flange extending radially outwardly from the wafer extract seal.

13. The chuck assembly of claim 1 further including one or more ring magnets in a recess in the ring bus bar, and a magnet seal sealing the recess.

14. The chuck assembly of claim 13 further including one or more backing plate magnet in a recess in an outer perimeter of the base plate.

15. The chuck assembly of claim 1 further including a plurality of centering pins spaced apart on a perimeter of the ring, with each centering pin extending through a clearance hole in the backing plate assembly.

16. The chuck assembly of claim 1 with the hub including abrasion resistant bushings.

* * * * *